US005901513A

United States Patent [19]

Mollenkopf et al.

[11] Patent Number: 5,901,513

[45] Date of Patent: May 11, 1999

[54] LAY IN CABLE CHANNEL FOR MODULAR OFFICE SYSTEMS

[75] Inventors: Lloyd C. Mollenkopf, Apple Valley; Russell J. Rein, St. Louis Park; James Hennan, Farmington; Brian A. Pleschourt, Northfield, all of Minn.

[73] Assignee: Rosemount Office Systems, Inc., Lakeville, Minn.

[21] Appl. No.: 08/868,779

[22] Filed: Jun. 4, 1997

[51] Int. Cl.[6] ..... E04B 2/42

[52] U.S. Cl. ..... 52/220.7; 52/36.1; 52/239; 108/50.02; 108/182; 312/196

[58] Field of Search ..... 52/36.1, 220.7, 52/239; 108/50.02, 182; 312/196, 223.6

[56] References Cited

U.S. PATENT DOCUMENTS

| | | | |
|---|---|---|---|
| 4,323,291 | 4/1982 | Ball . | |
| 4,407,101 | 10/1983 | Propst et al. | 52/220.7 X |
| 4,631,881 | 12/1986 | Charman . | |
| 4,654,756 | 3/1987 | Wilson et al. . | |
| 4,685,255 | 8/1987 | Kelley . | |
| 4,876,835 | 10/1989 | Kelley et al. . | |
| 4,932,177 | 6/1990 | Hinden . | |
| 4,948,205 | 8/1990 | Kelley | 312/223.6 X |
| 4,957,333 | 9/1990 | Hsu et al. . | |
| 5,038,539 | 8/1991 | Kelley et al. . | |
| 5,081,808 | 1/1992 | Bastian et al. . | |
| 5,172,529 | 12/1992 | Van De Riet | 52/220.7 |
| 5,184,441 | 2/1993 | Balfanz, Jr. . | |
| 5,214,890 | 6/1993 | Levitan et al. | 52/220.7 |
| 5,237,935 | 8/1993 | Newhouse et al. | 312/223.6 X |
| 5,277,005 | 1/1994 | Hellwig et al. . | |
| 5,277,007 | 1/1994 | Hellwig et al. . | |
| 5,287,666 | 2/1994 | Frascaroli et al. . | |
| 5,406,760 | 4/1995 | Edwards . | |
| 5,451,101 | 9/1995 | Ellison et al. | 312/223.6 |
| 5,479,747 | 1/1996 | Wu . | |
| 5,544,593 | 8/1996 | Canfield et al. . | |
| 5,557,895 | 9/1996 | Bendrell | 52/220.7 |
| 5,562,469 | 10/1996 | Nienhuis et al. . | |
| 5,568,773 | 10/1996 | Hung . | |
| 5,638,759 | 6/1997 | Klugkist | 312/223.6 X |
| 5,833,332 | 11/1998 | Marshall et al. | 312/223.3 |

FOREIGN PATENT DOCUMENTS

| | | | |
|---|---|---|---|
| WO 93021799 | 11/1993 | WIPO | 312/223.6 |

*Primary Examiner*—Carl D. Friedman
*Assistant Examiner*—Timothy B. Kang
*Attorney, Agent, or Firm*—Westman, Champlin & Kelly, P.A.

[57] ABSTRACT

A modular work station has spaced uprights that support a work surface, and a divider panel extending between the uprights. A communication cable channel extends between the uprights and has a passageway accessible for laying in a communication or other type of cable. At least one of the uprights has a recess that opens to an edge of the upright and aligns with the passageway in the communication cable channel such that a communication cable can extend through the recess to an adjacent modular work station. A cover member covers the opening in the upright channel to ensure that the cable is enclosed and yet can be laid in without threading it through openings in such uprights.

13 Claims, 6 Drawing Sheets

LAY IN CABLE CHANNEL FOR MODULAR OFFICE SYSTEMS

BACKGROUND OF THE INVENTION

The present invention relates to a cable channel for use in modular office systems, that permits cabling for communications, data and the like, primarily, to be merely laid in place without the need for threading the cable through ports or openings in upright supports for the modular components.

A number of modular systems have been designed for use in offices, which provide private work stations, separated by partitions, which are supported by spaced upright members. Communication cabling in such modular work stations generally has to be threaded through openings in the uprights. In some instances, cables also must be threaded through apertures or openings in a protective channel.

Office panels provided with a top lay in cable passageway, near the upper edge of the panels, are shown in U.S. Pat. No. 5,277,007. The cable channels are up out of reach and do not form a convenient location for mounting communication outlets or jacks.

U.S. Pat. No. 4,957,333 shows a cable, such as an information bus or power supply, that can be positioned through notches in upright supports for cabinets, with a bolt on cover over the notch. This is generally for providing ingress to and egress from a cabinet wall.

U.S. Pat. No. 5,214,890 discloses a frame work to which decorative covers are secured, and it is designed so that communication cables can be installed in the framework and supported on clips to pass around the upright supports.

SUMMARY OF THE INVENTION

The present invention relates to a lay in cable channel for use on modular office work stations which permits laying in communications and other cables without threading the entire length through ports or openings in uprights of adjacent work stations. Additionally, the cable channel permits crossing the cable from one side of a divider panel to the other, for two back to back work stations without threading the cable through apertures or openings.

As shown, a modular work station has at least one pair of uprights, that are used to support a vertical divider panel, and also support a horizontal work top. Just above the horizontal work top, a horizontal cable channel made according to the present invention is installed between the uprights. Each of the uprights has a "C"-shaped recess extending inwardly from an edge of the upright. The "C-shaped" recess or opening aligns with a passageway in the cable channel. The cable channel has a hinged cover which, when hinged down, permits laying in a communication or other cable, running it along the channel and placing the cable in the open side of the "C"-shaped opening to extend to the next work station. A divider on the interior of the channel has openings so cables can be passed across the divider. There are upright posts in the openings of the divider around which the cable can be looped.

Hinging of the covers permits quick access to the cable, no matter when the cable is to be serviced, as well as when it is going to be installed. The cover can be closed easily. The cable channel includes a unique arrangement of an angled wall for mounting outlet boxes or communication jacks at desired locations along the length of the channel. The jacks are conveniently placed above the work surface and positioned out of the way of working, but yet are readily accessible to the user.

The channel is made so that it can serve two sides of a work station vertical divider panel or, if desired, only one work station. The parts are extrusions of suitable plastic material and can be made in decorator colors.

DETAILED DESCRIPTION OF THE PREFERRED EMBODIMENTS

Figure 1:
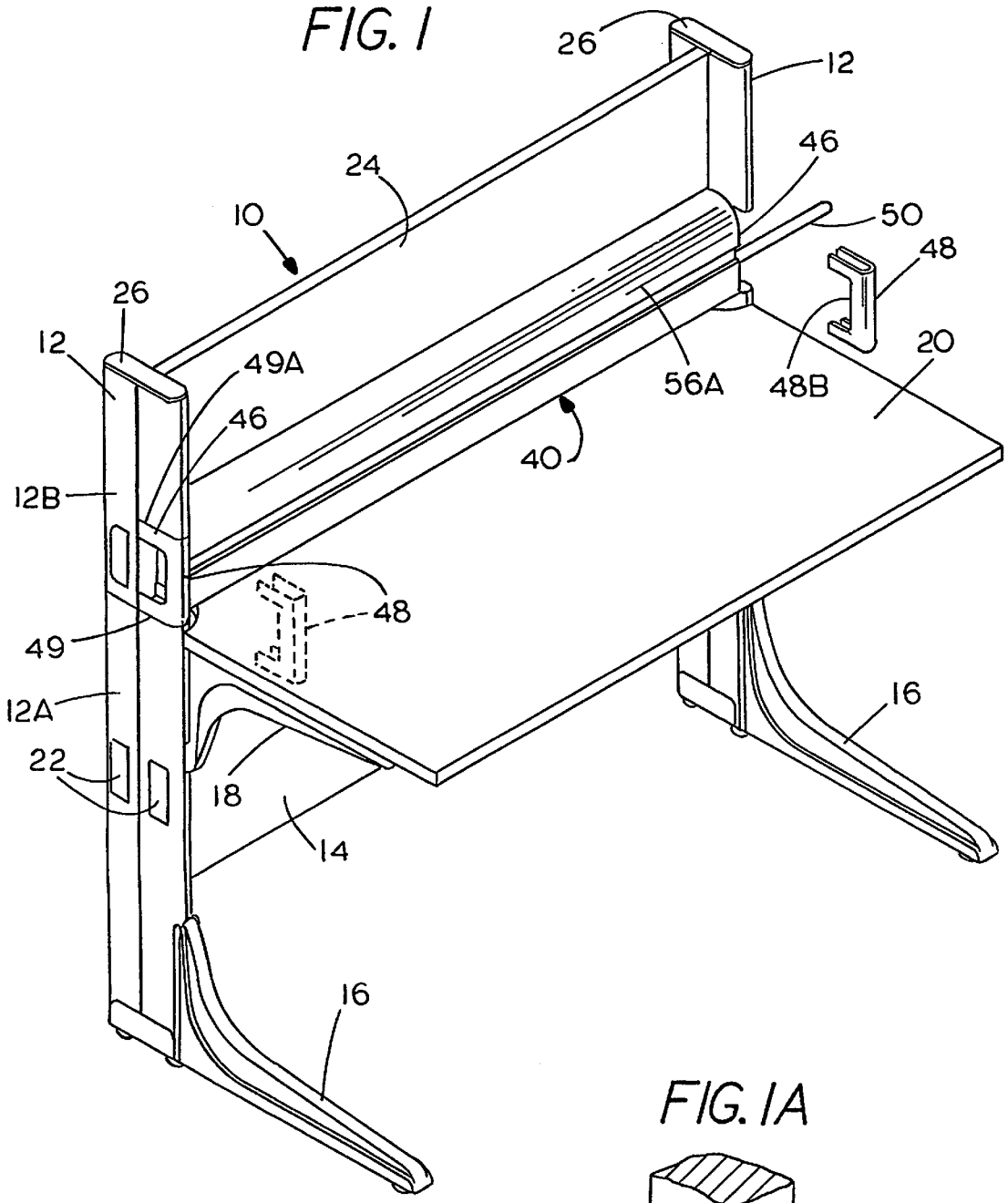
FIG. 1 is a perspective view of a work station surface having a cable channel made according to the present invention installed thereon.

A modular work station indicated generally at 10 shows a single work top unit, which can be used as a basic component for interior work spaces, and includes a pair of superstructure uprights 12 that are spaced-apart and are joined together with connecting panels, which include a lower vertical structural cross panel 14 shown in FIG. 1. The sides of the uprights 12 have grooves which receive the end edges 15 of the panel 14, and the panel is secured to the uprights to form a rigid assembly. The superstructure uprights 12 have cantilever foot pedestal support members 16 that are fastened in place as shown in U.S. Pat. No. 5,544,593. The superstructure uprights, in addition to the structural panel 14, support cantilever desk top support members 18 that in turn support a work or desk top 20 in a suitable manner. The superstructure uprights 12 thus are held together by the cross. The superstructure uprights are made as a base portion 12A and an upper extent portion 12B that are suitably secured together. The extension portion can be in various heights. The uprights formed in two interlocking sections, as shown in U.S. Pat. No. 5,544,593.

The super structure uprights 12 have through openings or ports 22 that pass through the uprights at desired locations. These ports are bounded by continuous edges, and cables or lies-must be threaded through these openings. The uprights 12 include grooves above the work top 20 which receive a divider panel 24. Suitable endcaps 26 can be placed on the tops of the superstructure uprights, and the units can be leveled, and then joined with other laterally-extending units as shown in FIG. 2 to form a desk system 30.

Figure 2:
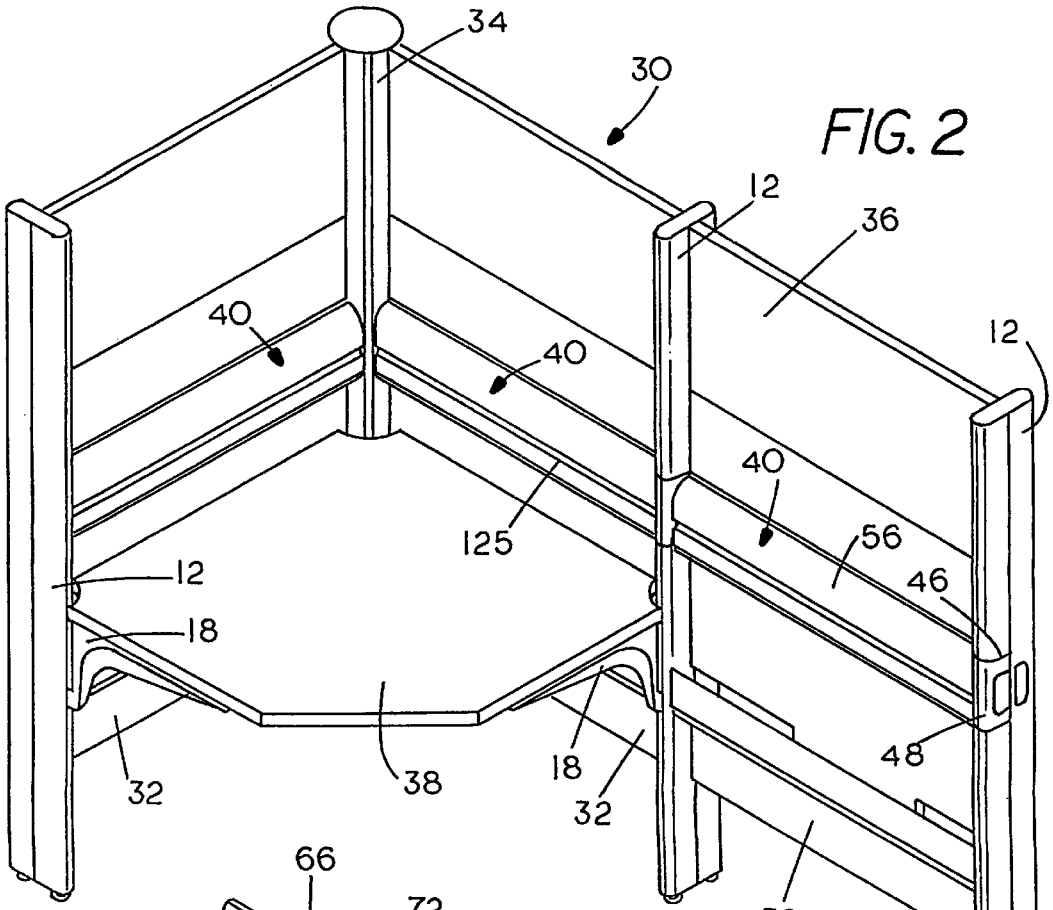
FIG. 2 is a perspective view of a multiple work station arrangement showing cable channels made according to the present invention in position.

In FIG. 2, the desk system 30 includes superstructure uprights 12 that hold vertical panels, that can be of different size and configuration, such as panels 32 for holding the uprights together, and use of a corner upright 34 for receiving lower panels 32 and upper divider panels 36.

Figure 3:
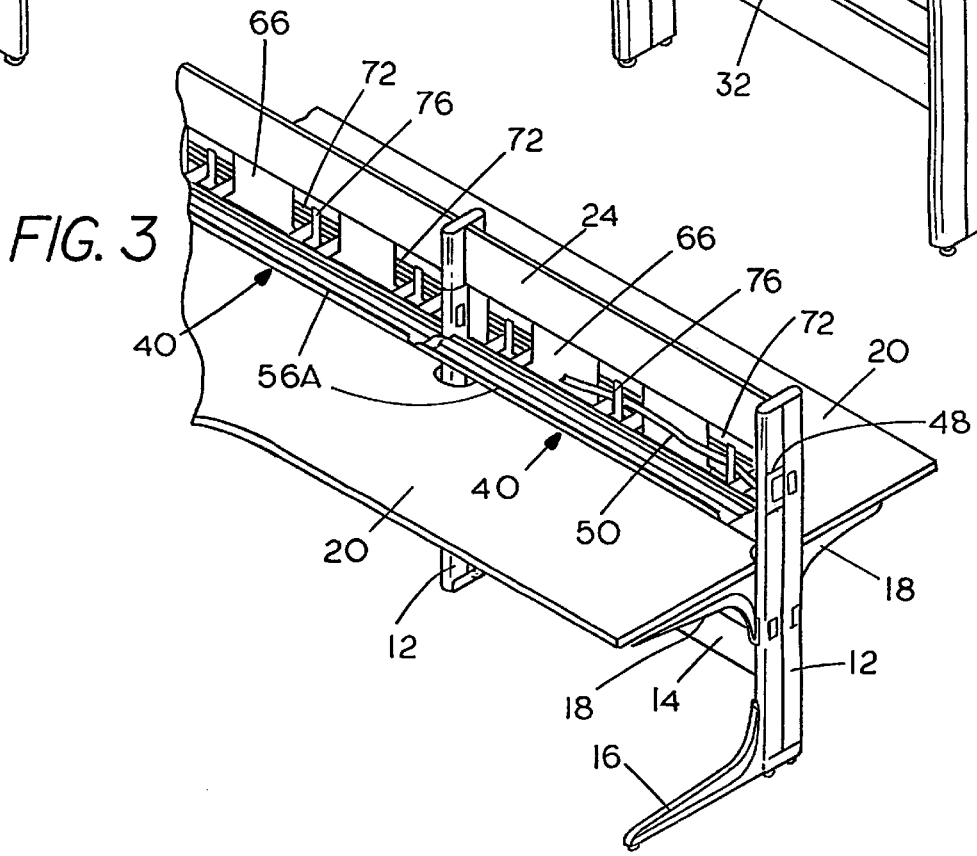
FIG. 3 is a fragmentary view similar to FIG. 2 showing the cable channels of the present invention in an open position.

In FIG. 2, a corner desk top 38 is supported on the cantilever supports 18. The details of the individual dividers can be selected by the user as desired. In FIG. 3, the work stations are shown with back to back work surfaces 20 separated by suitable dividing panels.

Figure 5:
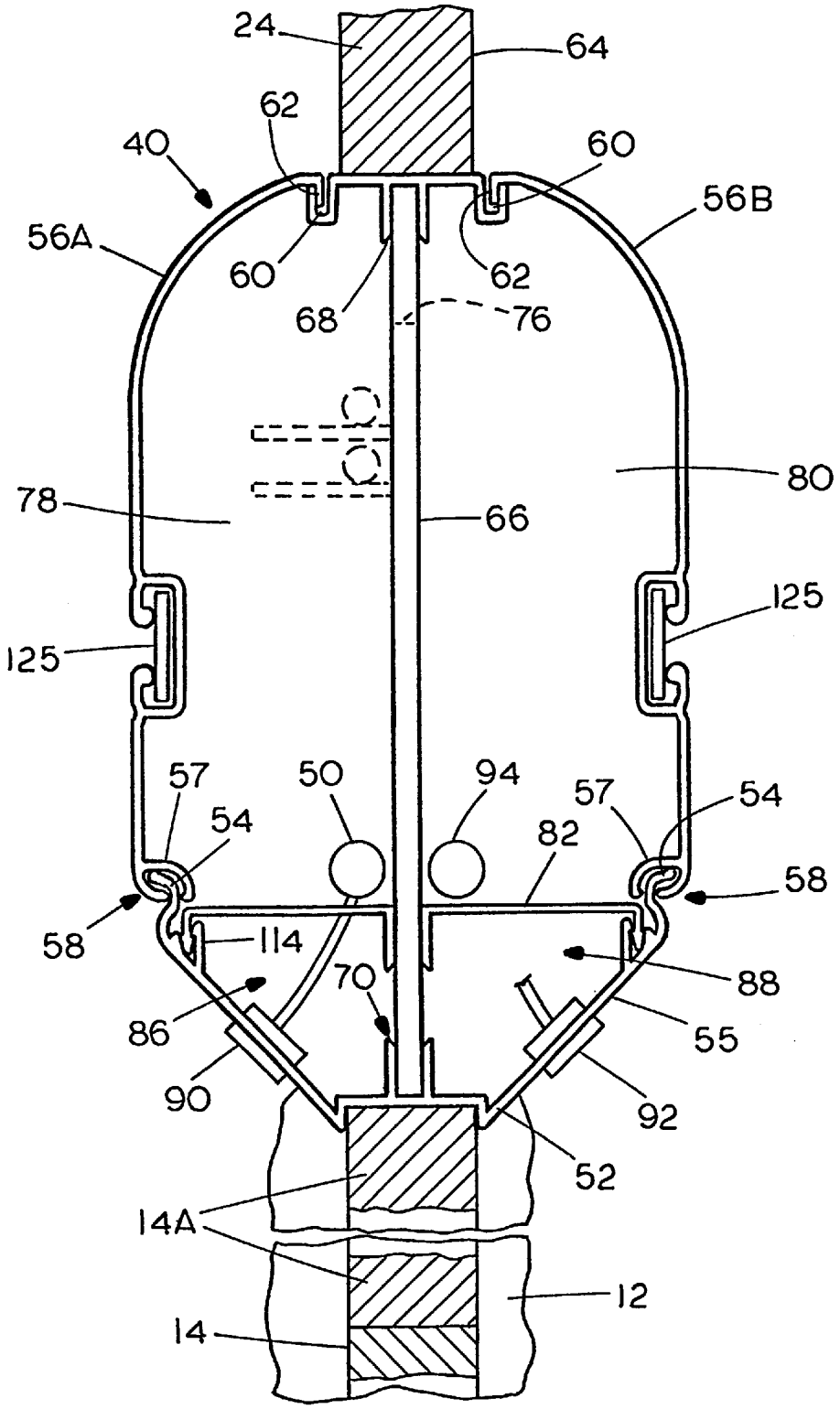
FIG. 5 is an end view of the cable channel of the present invention.
Figure 6:
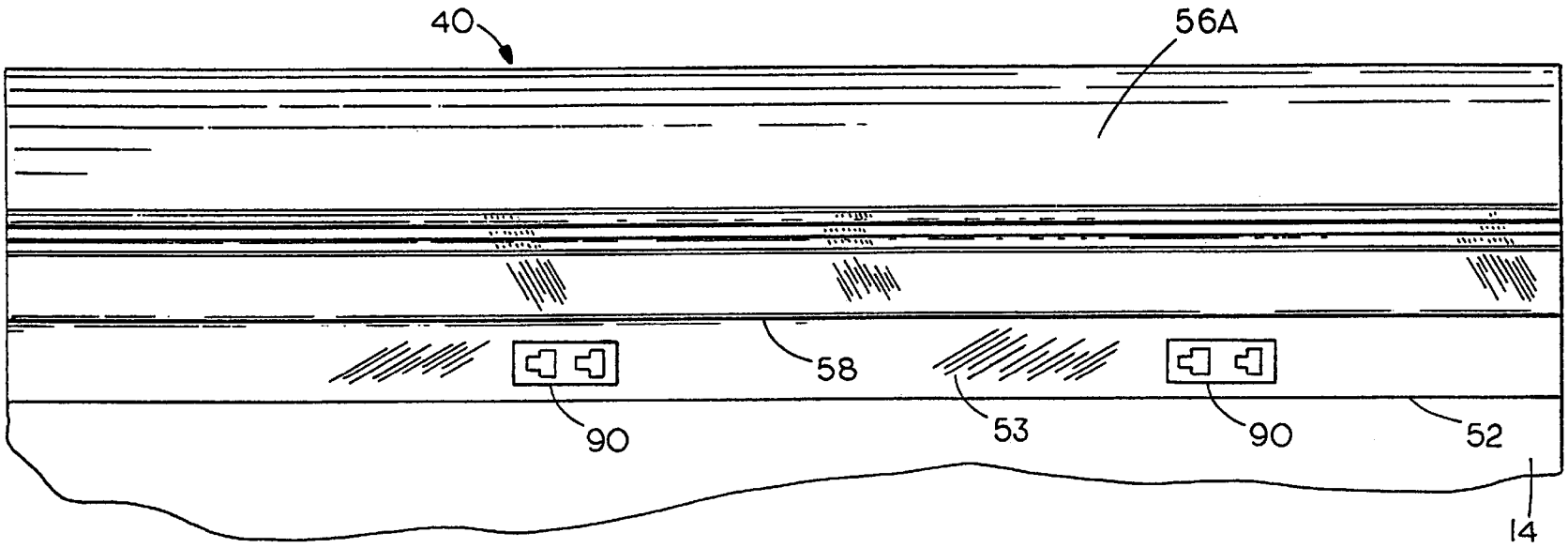
FIG. 6 is a side elevational view of the cable channel made according to the present invention.
Figure 7:
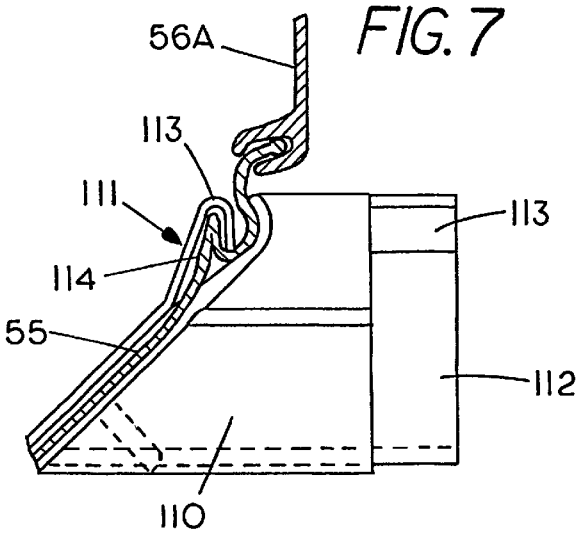
FIG. 7 is a side view taken on line 7—7 in FIG. 8 of a typical corner bracket used with the present invention and supported on the cable channel.

In order for data and communication cables in particular, and also electrical cables, if desired, to be laid in place for use conveniently, a cable channel member 40 made according to the present invention is supported on the upper edge of a vertical cross panel, which may be a privacy panel 14A as shown in FIG. 5, that rests on structural cross panel 14 or the cannel 40 can rest directly on panel 14 if it is at a proper height. The vertical dimensions of privacy panel 14A can be varied to position the channel 40 at a desired height above the work surface. Changing privacy panel 14 permits raising or lowering the channel 40. The privacy panel 14A and the structural panel 14 extend between the uprights 12 at each work station, and have ends that fit into vertical grooves on the uprights 12.

Each of the extension portions 12B of the superstructure uprights 12 has a generally "C"-shaped recess 46 defined therein that aligns with a passage in one half of the cable channel 40. The open edge of superstructure upright recess 46 can be closed with a cap or cover member 48 that slips into place, and has sidewalls 48A that mate with the sidewalls of the superstructure upright 12. The cap member 48 as shown has an opening 48B therethrough. The caps 48 can be slid into place after communication data or electrical or other cables, such as the cable indicated at 50, have been placed with back to back work tops, as shown in FIG. 3, the double passageway cable channel accommodates cables for both of the back to back work stations.

Figure 1A:
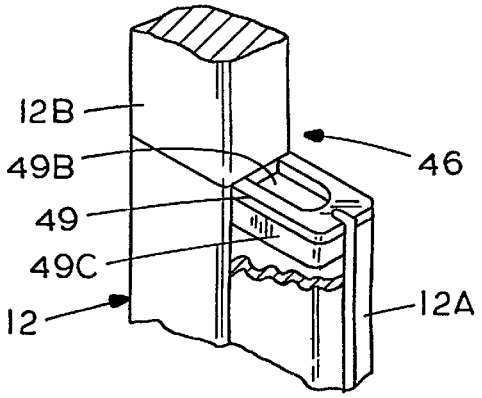
FIG. 1A is an enlarged perspective view of portions of a superstructure upright section to show a cover over the end portion, with parts broken away.

The cap or cover member 48 slides between cover members 49 and 49A and can be detented in place on the covers 49 and 49A. As shown in FIG. 1A, the cover 49 overlies the open center passageway and the top edge of the base section 12A of the uprights. Cover 49A is placed on the upright at the top of the opening 46.

The covers 49 and 49A have flanges 49C that fit into the openings in the uprights at the top and bottom of the recess 46 for holding the cover in place. The cover 49 has an opening 49B (See FIG. 1A) to permit cable to be passed downwardly through the hollow upright sections 12A or 12B and out an opening 22, if desired. This can accommodate additional locations for telephone or computer connections.

Figure 4:
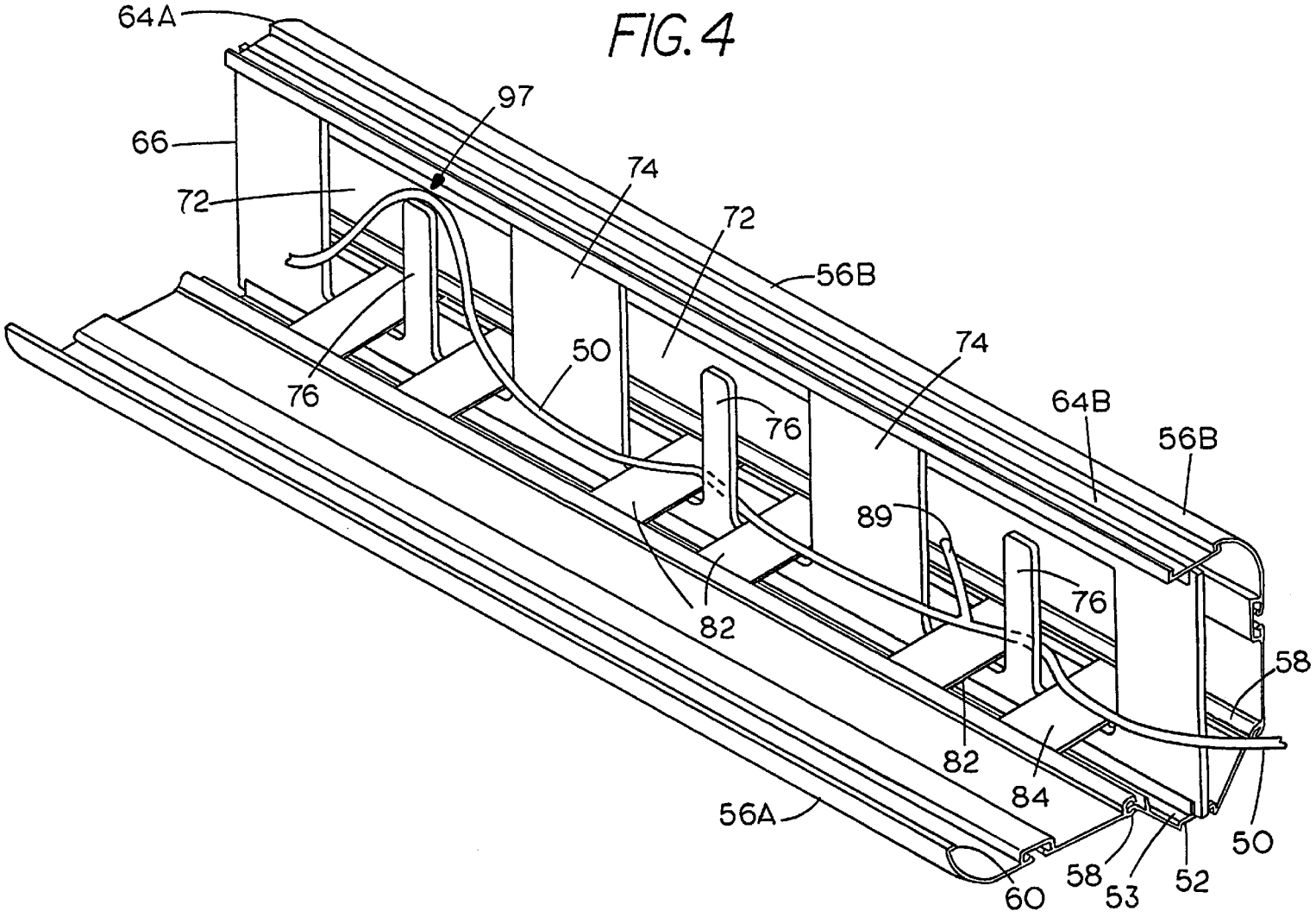
FIG. 4 is an enlarged perspective view of a cable channel shown in an open position.

Referring now to FIGS. 3, 4, 5 and 6, in particular, the cable channel 40 is made up of a number of extrusions, including a lower or base extrusion 52 that has a lower side groove 51 for resting on and receiving the upper edge of lower panel 14. The lower extrusion or base 52 has walls 53 and 55 that taper upwardly, and has curved upper edges 54 formed to provide a hinge connection relative to first and second covers 56A and 56B. The covers 56A and 56B have longitudinally extending edge receptacles 57 that define a hinge connection 58 that cooperates with the edge 54 to permit the covers 56A and 56B to pivot from a closed position that is shown in FIG. 5 to an open position shown in FIG. 3. The upper end of each cover has a lip 60 that fits into a provided receptacle 62 of a cap member 64. The cap member 64 is above a channel divider board or member 66 that is held in a U-shaped receptacle 68 formed by a pair of walls depending from the cap member 64. The ends of the divider member 66 fit into vertical grooves on each of the uprights 12. As shown in FIG. 4 the ends of divider member 66 extend beyond the cable channel 40. A further U-shaped receptacle 70 formed on the interior of the base 52 by a pair of upwardly extending walls. The channel divider board or member 66 thus holds the cap member 64 in position, so that when the cover members hinge, they can be latched in place with the lips 60 in the grooves 62. The upper cross panel 24 that is held between the superstructure uprights can rest on top of the cap member 64. In a modified form as shown in FIG. 4, the cap member 64A has a top groove 64B formed for receiving the lower edge portion of the panel 24.

The interior channel divider member 66, as shown in FIG. 4, has a plurality openings 72 therethrough. The lower portions of divider 66 are continuous across the space between the uprights 12. The upper edge portions of panels 74, which are between the openings 72, also are held in place in the "U"-shaped receptacle 68 of the cap 64. Each of the openings 72 has an upright, bottom-supported snubbing post 76 therein. The posts 76 have free upper ends and terminate below the cap 64 a desired distance. The cable 50 can be looped around posts 76 to aid in retaining the cable in place, but yet permitting it to be laid in around the post 76 and in the passageways 78 or 80 (FIG. 4) on opposite sides of the channel divider board or member 66.

Stabilizer cross-plates 82 extend across the base 52 on opposite sides of each of the upright posts 76, and as shown in FIG. 5, the ends of the cross plates clip into provided longitudinal receptacles on the upper edges of walls 53 and 55 of base member 52.

The cross plates 82 extend through openings 72 and form flat horizontal floor segments that separate the passageways 78 and 80 from lower passageways 86 and 88 that are above the walls 53 and 55 and below the cross plates 82. The cross plates 82 are spaced apart for access between top passageways 78 and 80, and lower passageways 86 and 88.

It can be seen in FIG. 4 that the cable 50 can be looped around the posts 76 by placing the cable through the clearance space above the top of the posts and below the top cap 64. That means that once the cover 56A is opened as shown in FIGS. 3 and 4, the cable 50 can be laid in place easily. With the cover members 48 of the uprights removed, the cables can be passed through the "C"-shaped recesses 46 on each side of the superstructure uprights 12. The caps or covers 48 can be secured in place with screws or detents can be used to hold the caps or covers in the uprights.

This laying of cable can continue beyond an individual work station and as shown in FIGS. 2 and 3, can extend across several of the work stations, and even around the corner, when suitable removable parts are provided on the corner posts.

In FIG. 4, it can be seen that a splice can be made in the cable to provide a branch cable 89. Two sets of communication jacks or receptacles can be installed, one set is on each of the walls 53 and 55. Communication jacks are indicated at 90 and 92, and can be connected into the cable 50 or 89, as desired. The outlets or jacks can be supported on the face of the covers 56A and 56B if desired.

Further, if electrical cables such as that shown at 94 in FIG. 5 are provided in the passageway 78 or 80 or in passageways 86 and 87, they can be connected to suitable electrical outlets along the walls 53 and 55.

In FIG. 4, it can be seen that the cable 50 also can be passed up over the top of a post 76 as shown at 97, for threading the cable around the upright post members 76 and passing the cable from one side of the divider 66 to the other, so that the communication or data carrying lines are available in both passageways 78 and 80.

The cover members 56A and 56B can have an extruded channel shown at 100 for holding a decorative strip if desired.

Figure 8:
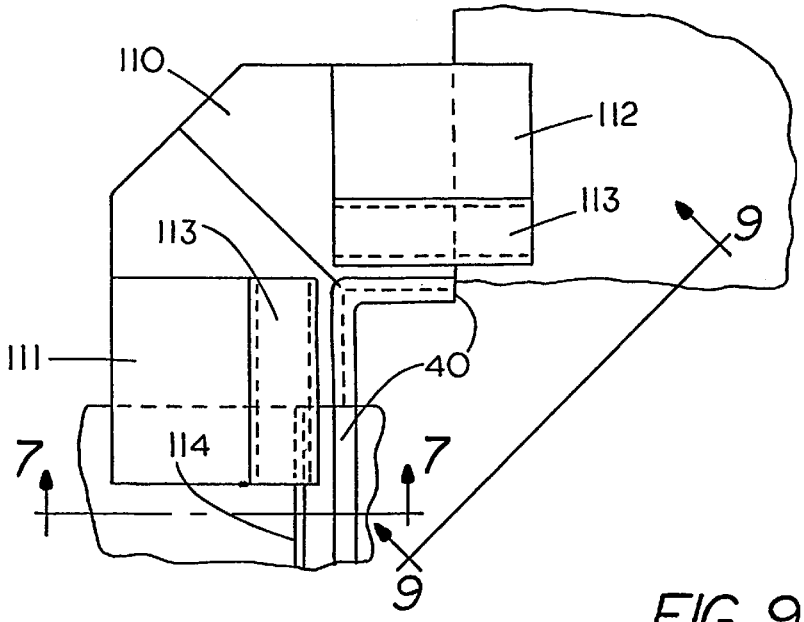
FIG. 8 is a top view of the corner bracket.
Figure 9:
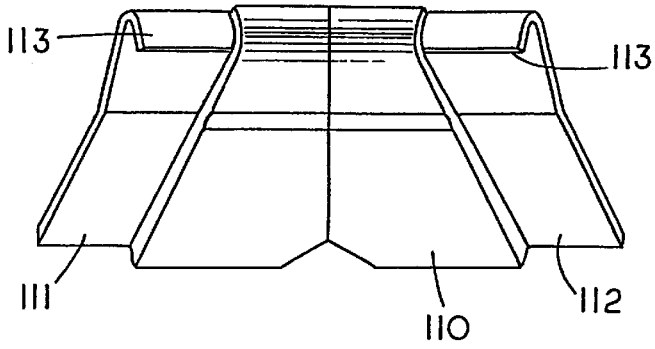
FIG. 9 is a front view of the corner bracket taken on line 9—9 in FIG. 8.

Referring to FIGS. 8, 9 and 10, a lower corner cover piece is shown that can be used for providing a decorative blending in a corner, by using a hanger for holding a molded insert in place. The molded corner piece indicated at 110 has a pair of hangers 111 and 112 adhered thereto using suitable adhesives. Each hanger has hook portions 113 that fits over the adjacent lip shown at 114 that holds the ends of the cross plates 82. When the cable channel is placed against a superstructure upright, the hook can be placed in the unoccupied end of the channel formed by lip 114 and held in place. The lengths of the cable channel can be trimmed as desired to accommodate the corner molding. The decorative molding 110 can then be hooked into place in the channels. This permits multiple use of the channel sections. The covers 56A can be terminated along the edge of the molded insert 110 which is shown at 110A. A similar corner filler member can be used for the cover region of the corner.

Thus, the cable channel 40 permits laying in of a cable 50 along upright dividers. The "C"-shaped recesses in the superstructure uprights have an open edge that can be covered after the cable for communication or other purposes has been laid in place permits extending the cables to adjacent work stations without threading long lengths of cables through openings. The channel divider member 66 keeps the cables from opposite sides separated if desired. The cable channels can be used on work tops on both sides of the divider panels extending between the superstructure uprights. The cable can be looped over the posts for strain relief. The jacks or receptacles are readily accessible on the inclined walls underneath the main passageways, and the connections are very simple to make. Any cable is also readily accessible by merely hinging down covers that are supported on the base. The cable channel can be modified to use only one cover for a single row of work stations.

Also several cables can be placed in the cable channel, although only one is shown. The cables can be supported on racks or pegs fixed to the sides of the channel divider member 66, and a shown in dotted lines in FIG. 5. Several pegs can be vertically stacked for supporting cables and keeping them separated.

Various accessories such as pencil holders, paper clip holders, tape dispensers and the like can be supported on the channel cover by hooking them into the recessed region or channel 125 used for a decorative strip.

Although the present invention has been described with reference to preferred embodiments, workers skilled in the art will recognize that changes may be made in form and detail without departing from the spirit and scope of the invention.

What is claimed is:

1. A cable channel structure for use in modular office systems comprising:

a work station having a pair of uprights upright having first and second sides and front and rear edges;

a divider panel coupled to the pair of upright upright and extending at substantially right angles to one of the first and second sides of the pair of upright;

a recess in both the first and second sides of at least one of the of upright extending inwardly from at least one edge of the at least one upright between the at least one edge edge and a plane of the divider panel to form an opening through the at least one upright;

a cable channel member extending along the divider panel and having a passageway aligning with said recess in the at least one upright, said cable channel member including a base section having a wall that inclines relative to the plane of the divider panel, and which is below the passageway relative to a work top supported by the at least one upright;

a receptacle for terminating a cable mounted on said inclined wall; and a cover member for the recess in the at least one upright to cover cables extending through the passage and the recess, the cover member forming a continuation of the at least one edge.

2. The structure of claim 1 wherein said cable channel member is below the divider panel, said cable channel member having an interior channel divider substantially aligning with the divider panel and forming passageways on each side of the plane of the divider panel.

3. The structure of claim 2 wherein said cable channel member has a hinged cover on the exterior of each of the passageways, said covers being on opposite sides of the plane of the divider panel, and work tops supported by the pairs of upright on opposite sides of the plane of the divider panel.

4. The structure of claim 2, wherein said channel divider has openings therethrough to provide for an opening between the passageways of the cable channel.

5. The structure of claim 4, wherein there is a support post in at least one of the openings in said channel divider, said support post terminating at a position spaced from other elements of the cable channel member to permit a cable to be looped over the end of the support post.

6. The structure of claim 4, wherein said base section has a recess for receiving a portion of the divider panel.

7. In a modular work station comprising a pair of uprights that are spaced laterally apart and have a work top supported thereon, the improvement comprising a cable channel member for carrying cabling between adjacent modular work stations, said cable channel member having a base, a channel divider member on the interior of the channel member, the base having an inclined wall between the work top and the channel divider member that extends upwardly in a direction away from a plane of the channel divider member, a passageway cover member hingedly connected to the base about a hinge axis extending between the uprights, said cover member cooperating with said channel divider member to form a passageway extending between the uprights, a "C"-shaped opening in at least a first upright opening to an edge thereof facing in a direction of the work top supported by the pair of uprights and positioned above the work top, said "C"-shaped opening aligning with the passageway such that cable can be laid into the passageway by opening the cover and moving the cable laterally into the "C"-shaped opening to an exterior side of the first upright, and a cap forming a continuation of an edge of the first upright for covering the "C"-shaped opening.

8. The improvement of claim 7, wherein said cover latches to portions of the cable channel member in a closed position, and hinges downwardly toward the work top to an open position.

9. The improvement of claim 7, wherein said channel divider member has an upright support post having a free end over which the cable can be looped.

10. The improvement of claim 7, and at least one receptacle for terminating a cable mounted on said inclined wall.

11. The improvement of claim 9, wherein said pair of uprights support back to back work tops extending in opposite directions from the plane of the channel divider member, said base having walls inclined away from the work tops in opposite directions from the plane of the channel divider panel, and a second cover mounted on an opposite side of the plane from the first cover, said second cover being latchable relative to portions of the cable channel member on an opposite side of the plane from the first cover.

12. The improvement of claim 11, wherein a plurality of receptacles are mounted on the inclined walls for terminating lines in at least one cable in the cable channel member.

13. The improvement of claim 11, wherein there are two work stations, at least one of the pair of uprights supporting a portion of a second work top with the "C" shaped opening providing a lay in opening for a cable extending to the second work station from the first mentioned work station.

* * * * *

UNITED STATES PATENT AND TRADEMARK OFFICE

CERTIFICATE OF CORRECTION

PATENT NO. : 5,901,513

DATED : May 11, 1999

INVENTOR(S) : Mollenkopf et al.

It is certified that error appears in the above-identified patent and that said Letters Patent is hereby corrected as shown below:

Claim 1, line 3, delete "upright".

Claim 1, line 5, delete "upright upright" and insert --uprights--.

Claim 1, line 7, delete "upright" and insert --uprights--.

Claim 1, line 9, delete "of upright" and insert --pair of uprights--.

Claim 1, line 19, delete "at least one upright" and insert --pair of uprights--.

Claim 3, line 5, delete "upright" and insert --uprights--.

Claim 10, delete "for terminating a cable mounted on said inclined wall" and insert --mounted on said inclined wall for terminating a cable--.

Signed and Sealed this

Fifteenth Day of August, 2000

*Attest:*

Q. TODD DICKINSON

*Attesting Officer*

*Director of Patents and Trademarks*

UNITED STATES PATENT AND TRADEMARK OFFICE

CERTIFICATE OF CORRECTION

PATENT NO. : 5,901,513
DATED : May 11, 1999
INVENTOR(S) : Lloyd Mollekopf et al.

It is certified that error appears in the above-identified patent and that said Letters Patent is hereby corrected as shown below:

Claim 1, line 11, delete "edge" (second occurrence)

Signed and Sealed this

Sixth Day of March, 2001

*Attest:*

Nicholas P. Godici

NICHOLAS P. GODICI

*Attesting Officer*

*Acting Director of the United States Patent and Trademark Office*